United States Patent [19]

Dallons et al.

[11] 4,389,912

[45] Jun. 28, 1983

[54] TWEEZERS FOR REMOVAL OF DUAL IN-LINE PIN (DIP) COMPONENTS

[75] Inventors: Robert E. Dallons, Agoura; William S. Fortune, Malibu, both of Calif.

[73] Assignee: Edsyn, Inc., Van Nuys, Calif.

[21] Appl. No.: 237,330

[22] Filed: Feb. 23, 1981

[51] Int. Cl.[3] ..... B25B 9/02; B25B 27/14

[52] U.S. Cl. ..... 81/43; 128/354; 29/278; 29/764; 29/739

[58] Field of Search ..... 81/43, 9.5 B; 128/346, 128/354; 29/278, 750, 758, 764, 739, 740, 741; 30/253, 233, 226

[56] References Cited

U.S. PATENT DOCUMENTS

| | | | |
|---|---|---|---|
| 789,539 | 5/1905 | Harris | 81/43 X |
| 1,284,060 | 11/1918 | Culman | 81/43 |
| 1,758,490 | 5/1930 | Aderer | 81/43 |
| 2,376,135 | 5/1945 | Frasher | 81/43 |
| 3,007,244 | 11/1961 | De Vern Austin | 30/162 |
| 3,253,327 | 5/1966 | McElligatt | 81/43 |
| 3,916,909 | 11/1975 | Kletschka et al. | 128/354 |

FOREIGN PATENT DOCUMENTS

| | | | |
|---|---|---|---|
| 55-68660 | 5/1980 | Japan | 29/764 |

*Primary Examiner*—James G. Smith

*Assistant Examiner*—Debra S. Meislin

*Attorney, Agent, or Firm*—Daniel T. Anderson

[57] ABSTRACT

A pair of tweezers specifically designed for removing DIP (dual in-line pins) components or other electronic components from a circuit board. To this end, the tweezers include a pair of legs secured together at the top portion and having a sharply inwardly bent end portion formed with claws for engaging the pins of a DIP component. Near the curved ends of the tweezers there may be provided a bumper for each leg extending through an opening in the leg. The bumper serves the purpose to hold the DIP component between the curved end portions and the bumpers. A sliding clamp is provided which is of general U-shape and provided with an elongated slit. The clamp may be secured by a knurled nut extending through an opening in the legs of the tweezers. Hence, the clamp may be slid downwardly of the legs to squeeze them together. Thus, the opening between the jaws may be adjusted to the size of the component to be removed. A spring-biased pin may alternatively be secured to the lower portions of the legs to assist in withdrawing the DIP component. Finally, the jaws may be made exchangable by simply removing the lower portions of the tweezers. They may be removably secured together by an interlocking construction of the two end portions of the legs.

11 Claims, 15 Drawing Figures

Fig. 1.
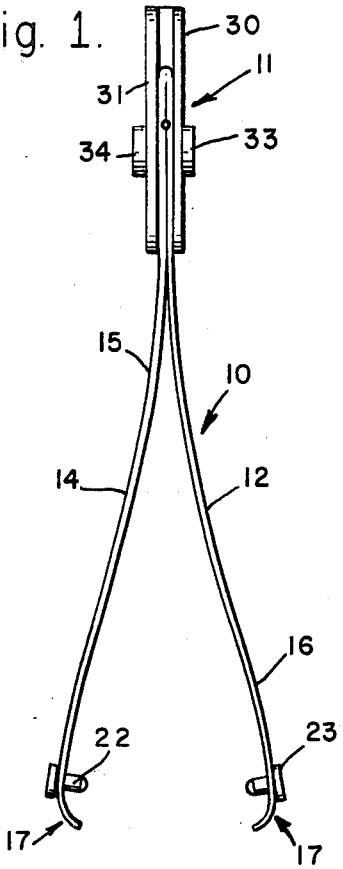
Fig. 2.
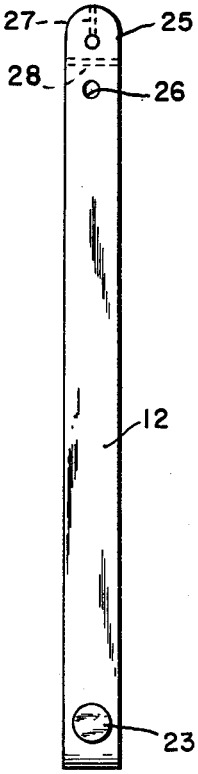
Fig. 3.
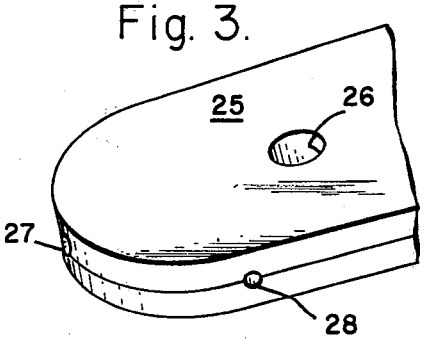
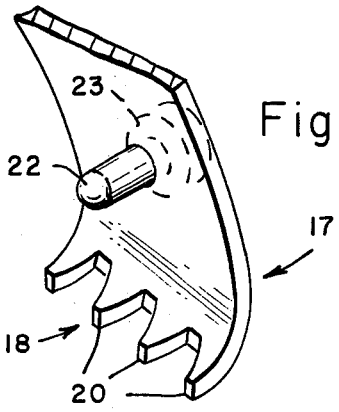
Fig. 4.
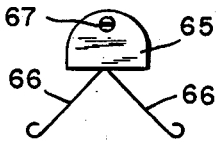
Fig. 11.
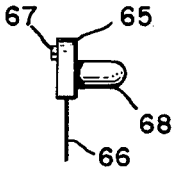
Fig. 12.
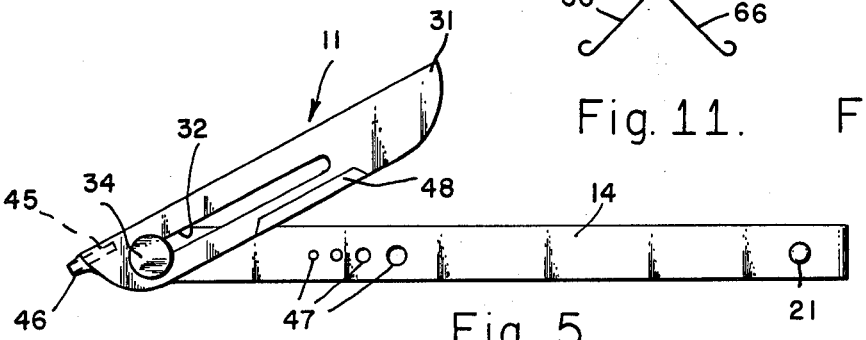
Fig. 5.
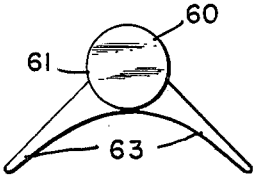
Fig. 9.
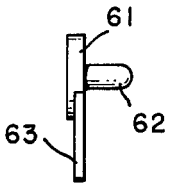
Fig. 10.
Fig. 8.
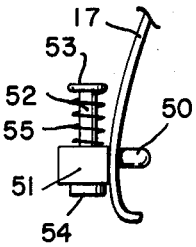
Fig. 7.
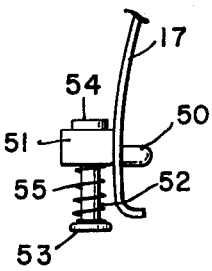

TWEEZERS FOR REMOVAL OF DUAL IN-LINE PIN (DIP) COMPONENTS

BACKGROUND OF THE INVENTION

This invention relates generally to a pair of tweezers and particularly to tweezers specifically designed for removing DIP (dual in-line pins) components from a circuit board.

It is generally required to remove DIP components or other electronic components from a circuit board for repair or replacement. To this end it is desirable to provide a simple tool which may be adjustable to accommodate DIP components of different sizes. Furthermore, it would be desirable to clamp the tweezers so that they will firmly hold the DIP component while the solder is being heated to loosen the DIP component to be able to remove it from the circuit board. To this end, it would be desirable to provide spring means to assist in the removal of the DIP component.

Additionally, it may be necessary to straighten out the pins of a DIP component, either individually or by straightening each row of pins at one time.

Finally, it may be desirable to be able to exchange the jaws of the tweezers for different sizes of jaws, for different configurations of jaws, or for larger and wider components.

SUMMARY OF THE INVENTION

The tweezers of the present invention will accomplish all of these requirements with a relatively simple instrument and with few accessories. Thus, the tweezer legs have an upper portion which is substantially straight, followed by an inwardly curved or convex portion, which is followed by an oppositely curved portion. Further, each leg has a sharply inwardly bent end portion formed into claws for gripping the DIP component.

A sliding clamp is provided having two parallel portions and a short bridge portion interconnecting the two surfaces to provide a U-shaped structure. The parallel portions of the clamp are provided each with an elongated slit, and means are provided for securing the clamp to the legs through an aperture in the upper portion of the legs. Thus, the clamp may be slid up and down to increase or decrease the distance between the jaws to accommodate different sizes of DIP components.

The ends of the legs may be provided with a bumper extending through an opening in the end portion of the legs. This serves the purpose to hold the DIP component for removal.

Additionally, spring means may be provided to assist in the removal of the DIP component. The clamp may also be utilized for cutting wires of different sizes. The upper portion of the legs may be provided with small holes for straightening out the pins of the DIP component. Finally, the clamp may be provided with a similar suitable hole.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 1 is a side elevational view of a pair of tweezers including a sliding clamp and showing an embodiment of the present invention;

FIG. 2 is a front elevational view of one of the legs of the tweezers;

FIG. 3 is a view in perspective on enlarged scale illustrating the upper portion of the pair of legs with two small holes extending therethrough at right angles, as well as a central aperture for slidably securing the sliding clamps to the legs;

FIG. 4 is a view in perspective on enlarged scale illustrating the lower end portion of one of the legs formed into jaws, as well as a bumper secured adjacent to the jaws;

FIG. 5 is a front elevational view of a modified pair of tweezers showing the legs provided with a graduated row of openings for passing wire therethrough, the clamp being shown opened and provided with a cutting edge for cutting various sizes of wires;

FIG. 7 is a side elevational view of one of the legs of the tweezers provided with a spring-biased pin for assisting in the removal of a DIP component;

FIG. 8 is a side elevational view similar to that of FIG. 7 but showing the spring-biased pin rotated through 180 degrees so as not to interfere with the action of the jaws;

FIGS. 9 and 10 are, respectively, a front elevational and a side elevational view of a modified spring component for assisting in the removal of a DIP component;

FIGS. 11 and 12 are, respectively, a front elevational and side elevational view of another form of spring component to help in the removal of a DIP component;

DESCRIPTION OF THE PREFERRED EMBODIMENTS

Figure 6:
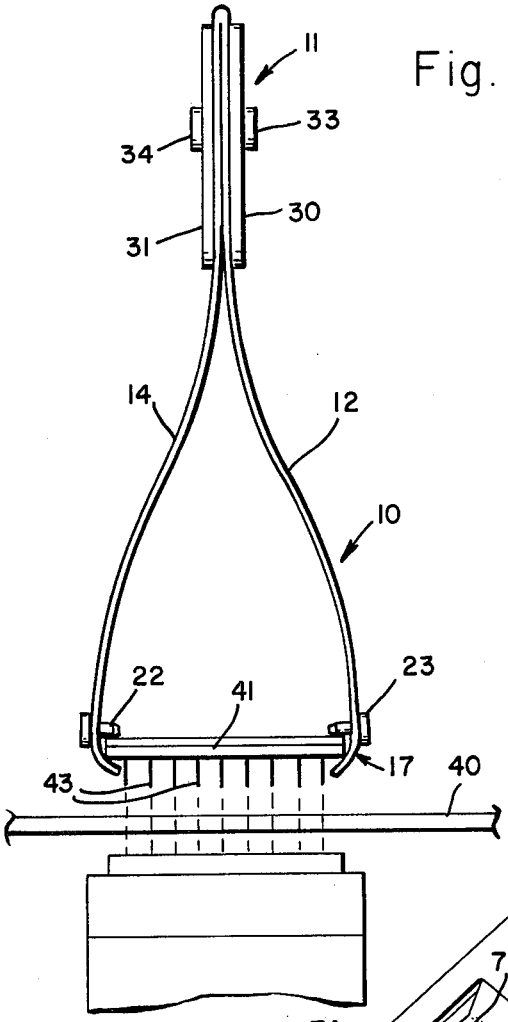
FIG. 6 is a side elevational view of a pair of tweezers similar to that of FIG. 1 but showing a DIP component being removed from a circuit board, the solder of the pins of the component having been heated by a soldering instrument.

Referring now to FIGS. 1 through 6, there is illustrated, by way of example, a preferred embodiment of the tweezers of the present invention. Thus, as shown in FIG. 1, the tweezers, or squeezers, include a pair of tweezers 10 and a sliding clamp 11. The tweezers have two legs 12 and 14, which may be identical in construction. As clearly shown in FIG. 1, each tweezer leg 12, 14 has an upper portion 15 with a radius of curvature which is outside the two legs 12 and 14 to provide an inwardly curved convex portion. This is followed by a portion 16 which is oppositely curved; that is, the radius of curvature is to the left of leg 12 or to the right of leg 14. The uppermost portion of the two legs 12 and 14 may be substantially straight.

The lowermost portion of the legs 12 and 14 is bent sharply inwardly, as shown at 17, and ends in a claw 18, forming teeth 20 with spaces between each, as clearly shown in FIG. 4 on enlarged scale. Furthermore, near the bent-over jaws 17 of the legs is a circular hole or aperture 21 through which extends a pin 22 and which forms a bumper. The opposite side of the pin 22 is provided with an enlarged circular button 23. The pin 22 has a force-fit through the opening 21.

The two legs 12 and 14 are secured together at the head portion 25, for example by welding. Near the uppermost head portion 25 is another circular hole or aperture 26 for a purpose to be presently explained. Extending vertically through and between the two legs 12 and 14 is a hole 27. Another hole 28 extends at right angles to the first hole 27. As will be more fully described hereinafter, the holes 27 and 28 through the head portion 25 of the two legs serve the purpose to straighten out the pins of a DIP component.

The sliding clamp 11 is illustrated particularly in FIGS. 1 and 5. It consists of two parallel portions 30, 31, through which extends an elongated longitudinal slit 32. Two parallel portions 30 and 31 are interconnected on one side by a bridge to form a generally U-shaped structure.

By means of a suitable lock screw and nut 33 and 34, which may be knurled and which extend through the opening 26 through the two leg portions, the sliding clamp 31 may be secured in a plurality of positions.

Thus, the two jaws 17 of the two legs may be opened wider or may be compressed together by simply sliding the sliding clamp 11 up or down. This action will, at the same time, vary the spring tension in the free or lower portion of the two legs 12 and 14.

The tweezers, or squeezers, of the invention are primarily intended for lifting a DIP component from a circuit board in the manner illustrated in FIG. 6. It is to be understood, however, that the squeezers of the invention may be used to remove other electronic components from a circuit board.

Shown in FIG. 6 is a circuit board 40 on which a DIP component 41 was connected by its pins 43 extending through the circuit board 40. The dual in-line pins are desoldered or heated by a two-row desoldering tip of the type illustrated (FIGS. 2 through 4) and claimed in one of the applicant's prior patents, U.S. Pat. No. 4,187,973. Thus, after the solder has been sufficiently softened, the DIP component may simply be lifted off the circuit board 40. The purpose of the bumpers or pins 22 is to hold the DIP 41 between the bumpers and the turned-over end portions 17 of the jaws 20.

The DIP components should have pins which are exactly parallel to each other and which are straight and evenly spaced. If they are not in that condition, they may be straightened out by the tweezers of the present invention. Thus, a whole row of pins may be straightened out by being placed between the opposed uppermost portions of the legs 12, 14, which may then be compressed by pushing down on the sliding clamp 11 to an area immediately above the pins. Alternatively, the sliding clamp 11 may be rotated over the legs and then pushed over a row of pins so that the DIP extends through the open side of the clamp. If one of the pins is not straight, it may be straightened out by pushing it into either the hole 27 or the hole 28 between the two legs 12 and 14. Either one of the holes may be used, depending on the position of the pin which needs to be straightened out.

Additionally, the sliding clamp 11 may also be provided with a hole 45 (see FIG. 5). This hole may, for example, be provided with a metallic insert 46 of a hard metal which may be used to straighten pins of a DIP component.

Additionally, the sliding clamp 11 and the tweezers 10 may be provided with means for cutting wires of different diameters. To this end, the two legs 12 and 14 may be provided with a row of openings 47 of graduated sizes to pass therethrough wires of different diameters. The wires may be cut by an insert 48 which may be slid into a suitable slot in one or both of the clamp portions 30 and 31. The insert 48 may be of metal or a suitable plastic and provided with a sharp edge to cut the wire. Alternatively, the clamp portions 30, 31 may be provided with sharp cutting edges. Thus, the clamp 11 and the legs 12, 14 have an action similar to that of a folding knife.

It will be appreciated that with the tweezers, or squeezers, of the invention, it is possible to remove DIP components of a large range of sizes. The components may be held at either the two ends or on opposite sides, depending on their size.

It should also be noted that the two legs 12 and 14 preferably are of the same configuration and may, for example, consist of spring steel which is suitably bent, with the ends 17 being bent sharply up. The jaws 18, 20 may be punched out. The sliding clamp 11 may, for example, consist of an acetal resin. The cutting edge 48 may either be of metal or of a stiff plastic such as that sold by DU PONT under the trade name of VESPAL. The bumper 22, 23 may consist of urethane.

In order to assist the removal of a DIP component from a circuit board, it may be desirable to provide a suitable DIP puller means. As shown in FIGS. 7 and 8, this may consist of a spring-loaded DIP puller. The puller may consist of a pin 50 passed through the hole 21 in the end portion 17 of one of the legs. Connected to the pin 50 is a boss 51 having a circular aperture through which passes another pin 52 having heads 53 and 54 on opposite sides. The pin 52 is loaded by a spring 55 which bears against the boss 51 and the head 53.

FIG. 7 illustrates the spring-loaded DIP puller in its working position; that is, ready to engage the circuit board 40 of FIG. 6. When it is not desired to utilize the spring-loaded DIP puller, it is rotated through 180 degrees into the position of FIG. 8. The pin 50 should fit the aperture 21 so that it is easy to rotate.

FIGS. 9 and 10 illustrate another embodiment of the DIP puller of the invention. The DIP puller 60 preferably is molded in one piece. It includes a cylindrical body 61 from which a pin 62 extends at right angles to pass through the aperture 21. It also has a pair of legs 63 which are widely spaced from each other and which have spring properties. The DIP puller of FIGS. 9 and 10 may, for example, consist of acetal sold in the trade under the name of DELRIN.

Another embodiment of the DIP puller is illustrated in FIGS. 11 and 12. It consists of a plastic body 65 through which extend two piano wires 66. They may be secured in the plastic body 65 by a set screw 67. A pin 68 extends from the body 65 to engage the aperture 21. The body 65 may consist of a suitable moldable plastic.

Figure 13:
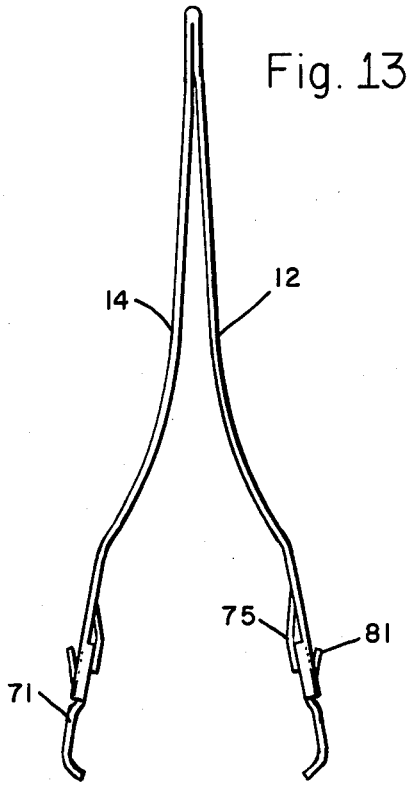
FIG. 13 is a side elevational view of another modification of the tweezers of the present invention, having removable end portions for exchanging the jaws for a different configuration of jaws.
Figure 14:
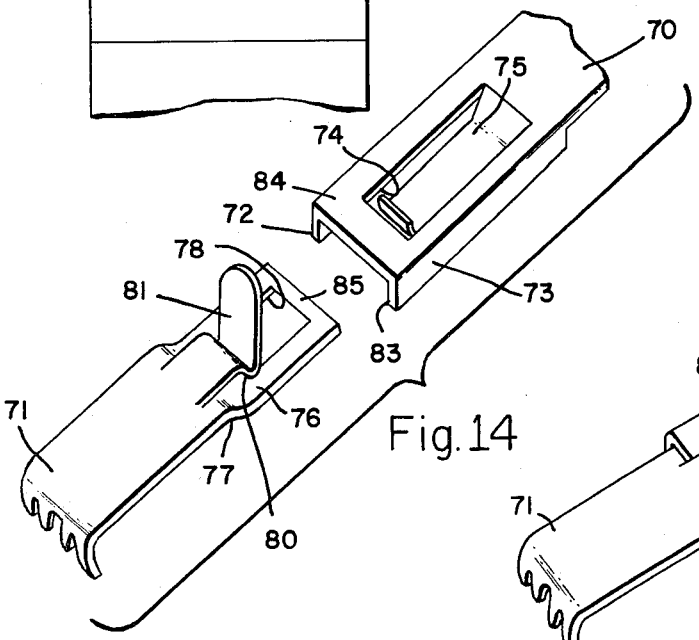
FIG. 14 is an exploded view in perspective of the end portion of one of the tweezer legs and the portion of the jaws mating with the tweezer end portion.
Figure 15:
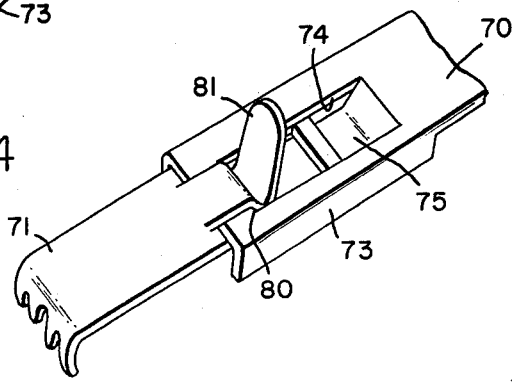
FIG. 15 is a view in perspective of the assembled jaw portion and tweezer end portion.

It may be desirable in some cases to provide the tweezers, or squeezers, of the present invention with removable claws. Thus, different configurations of claws may be provided, or claws which are longer, narrower, or wider. Also, the material of which the claws are made may be changed. Thus, the claws may be made of a heat-conducting material to protect the electronic component to be desoldered from excessive heat. This may be accomplished with the embodiment of the invention illustrated in FIGS. 13 through 15.

The legs 12 and 14 may be made in the same manner as before, except that the lower portions of the legs are substantially straight, as shown at 70. The jaws 71 are replacable and may, for example, consist of a corrosion-resistant stainless steel. As shown particularly in FIGS. 14 and 15, the lower leg portion 70 is of generally U-shaped construction, having two downwardly extending edges 72 and 73. A substantially rectangular aperture 74 is provided near the end of the end portion 70 of the legs. A downwardly curved tongue 75 having an upwardly curved tip extends below the aperture 74.

The jaw portion 71 has a downwardly extending portion 76 forming a bend at 77 and has a substantially rectangular opening 78. A tongue 80 is formed from the rectangular portion 78 and has a downwardly extending semicircular portion or projection 80 from which extends upwardly a tab 81. The two portions are pushed together until the front portion 83 of the leg portion 70 rests against the downward bend 77. The projection or protrusion 80 snaps over the ridge 84 which defines the rear opening of the aperture 74. The front portion 85 of the jaw portion 71, in turn, is engaged by the tip of the tongue 75.

The tab 81 serves the purpose to unlock the jaw 71 by simply pulling it rearwardly and upwardly to lift it off the ridge 84.

There has thus been disclosed a pair of tweezers, or squeezers, for removing DIP components from a circuit board. The squeezers are provided with a slidable clamp for adjusting the distances between the claws of the tweezers. This will also make it possible for the tweezers to be securely fastened to a DIP component so that the operator can soften the solder without having to hold on to the tweezers. Both the tweezers and the sliding clamp may be provided with holes for straightening out individual pins of a DIP. A row of pins may be straightened out between the upper portions of the tweezers.

Furthermore, the lower edge of the sliding clamp may be provided with a sharp portion to cut off wires which may be inserted through a graduated row of holes in the tweezer legs. Various spring-loaded DIP pullers are disclosed for assisting in removing a DIP. Finally, a spring-like mechanism is disclosed for removably securing claws of different configurations and sizes.

What is claimed is:

1. A pair of tweezers for removing a DIP component from a circuit board comprising:

(a) a pair of tweezer legs of identical shape, each of said legs having an upper portion which is substantially straight, followed by an inwardly curved, convex portion and followed, in turn, by an oppositely curved portion;

(b) each of said legs having a sharply inwardly bent end portion formed into claws for gripping a DIP component, and a circular aperture near the inwardly curved end portion;

(c) means for securing the uppermost portions of said legs together; and (d) a sliding clamp having two parallel portions for sliding along the upper portion of said legs and interconnected to form a U-shaped structure, said clamp being rotatable with respect to said legs when disposed at the uppermost portion of said legs, each of said parallel portions being provided with a centrally located elongated slit, and means on said upper portions of said legs and extending through an opening for securing said clamp in a desired position along said slit with respect to said legs, to space said claws a desired distance apart for gripping a particular DIP component, whereby a row of pins of a DIP component may be straightened out by placing it between the upper portions of said legs when said clamp is rotated away from said legs and thereafter squeezing said legs together by said clamp, and whereby the space between said claws is adjustable by sliding said clamp up or down.

2. A pair of tweezers as defined in claim 1 wherein a bumper element having a rounded end and a pin extending therefrom is provided, said pin extending through said aperture in each of said legs, said pin having a press fit with said aperture.

3. A pair of tweezers as defined in claim 1 wherein said uppermost portions of said legs are provided with a first hole extending therethrough, substantially parallel to the surface of said legs, and a second hole extending substantially parallel to the leg surfaces and substantially at right angles to said first hole, said holes having a size to receive one of the pins of a DIP component.

4. A pair of tweezers as defined in claim 1 wherein one of said legs has a row of openings of graduated size to pass therethrough wires of different diameters, and said clamp has a cutting edge thereon extending over said row of openings when said clamp is closed, thereby to permit cutting of wires of different diameters.

5. A pair of tweezers as defined in claim 1 and including a DIP puller having spring means and having a pin extending laterally therefrom and insertable through said aperture near the inwardly curved end portions of said legs for facilitating pulling out of a DIP component from a circuit board.

6. A pair of tweezers as defined in claim 5 wherein said DIP puller and spring means is rotatable about said pin through an angle of approximately 180 degrees to remove said spring means from the working end of the tweezers.

7. A pair of tweezers as defined in claim 5 wherein said spring means includes a holder and a pin extending substantially parallel to each of said legs and through said holder and a spring wound about said pin for tending to move said tweezers upwards against a circuit board.

8. A pair of tweezers as defined in claim 5 wherein said DIP puller and spring means includes a plastic material having flexible legs with spring properties secured to said pin.

9. A pair of tweezers as defined in claim 5 wherein said DIP puller and spring means includes a holder and two bent legs of a metal having spring-like properties.

10. A pair of tweezers as defined in claim 1 wherein the head portion of said clamp near the uppermost portion of said legs is provided with an aperture receiving an insert of a hard material having a hole extending therein substantially parallel to its long axis to receive a pin of a DIP component.

11. A pair of tweezers as defined in claim 1 wherein each of said oppositely curved end portions has a substantially U-shaped end and including an open central portion defining a ridge, and a removable end portion including said claws and having a downwardly extending end forming a protrusion to engage said ridge on said oppositely curved end portion, said downwardly curved end portion forming an upstanding tab for removably locking it to the ridge of said open central portion.

* * * * *